US007387343B1

(12) United States Patent
Hsieh

(10) Patent No.: US 7,387,343 B1
(45) Date of Patent: Jun. 17, 2008

(54) CONSTRICTING DEVICE FOR THE FOOTREST RING OF A CHAIR

(76) Inventor: Kun-Yu Hsieh, No. 55, Lane 373, Sinsheng S. Rd., Madou Township, Tainan County (TW)

( * ) Notice: Subject to any disclaimer, the term of this patent is extended or adjusted under 35 U.S.C. 154(b) by 0 days.

(21) Appl. No.: 11/709,090

(22) Filed: Feb. 22, 2007

(51) Int. Cl.
*A47C 7/50* (2006.01)

(52) U.S. Cl. ..... 297/423.38; 248/230.2; 248/231.31

(58) Field of Classification Search ..... 297/423.25, 297/423.38; 248/161, 188.2, 188.5, 230.2, 248/231.31; 403/104, 109.1, 109.5, 342
See application file for complete search history.

(56) References Cited

U.S. PATENT DOCUMENTS 3,458,234 A * 7/1969 Bates ..... 297/423.38
4,234,151 A * 11/1980 John et al. ..... 248/354.3
4,623,195 A * 11/1986 Avella ..... 297/423.38
5,011,104 A * 4/1991 Fang ..... 248/125.8
5,492,430 A * 2/1996 Jones ..... 403/109.5
6,695,407 B1 * 2/2004 Lin ..... 297/423.38
6,761,274 B1 * 7/2004 Chen ..... 403/109.1
2003/0151291 A1 * 8/2003 Lin et al. ..... 297/423.38

* cited by examiner

*Primary Examiner*—Peter R. Brown
(74) *Attorney, Agent, or Firm*—Rosenberg, Klein & Lee

(57) ABSTRACT

A constricting device for the footrest ring of a chair includes a constricting unit assembled between the center tube of a chair and the conical sleeve of a footrest ring. The constricting unit consists of a constricting main body and a fixing ring combining the constricting main body and the sleeve of the footrest ring. The constricting main body is a conical body fitted with the conical sleeve of the footrest ring, having its center bored with a fitting hole to be fitted around the center tube of the chair and its circumferential wall cut with plural openings. When the footrest ring is pressed downward by treading, the conical sleeve of the footrest ring will press the conical constricting main body and make it constricted to closely hold the center tube of the chair, able to stably fix the footrest ring on the center tube of the chair.

4 Claims, 5 Drawing Sheets

CONSTRICTING DEVICE FOR THE FOOTREST RING OF A CHAIR

BACKGROUND OF THE INVENTION

1. Field of the Invention

This invention relates to a constricting device for the footrest ring of a chair, particularly to one provided with a conical constricting unit assembled between the conical sleeve of a footrest ring and the center tube of a chair. By mutual restraint and relative pressing of the conical sleeve of the footrest ring and the conical constricting main body of the constricting unit, the footrest ring can be firmly fixed on the center tube of the chair and conveniently adjusted in position.

2. Description of the Prior Art

As commonly known, chairs are indispensable to a family and an office. Some chairs are provided with soft seats for a user to sit thereon with comfort, others are respectively provided with an arc-shaped backrest according to ergonomics and still others are respectively assembled with armrests at the opposite sides for a user's hands to be comfortably set thereon. In addition, some high chairs are respectively disposed with a footrest ring for a user's feet to comfortably rest thereon. These above-mentioned additional designs of the chair enable a user to sit comfortably in the chair for a long time.

A conventional high chairs or desk chair provided with a footrest ring includes a sleeve secured in the center of the footrest ring to be fitted on the center tube of a chair. The sleeve of the footrest ring is diametrically bored with a threaded hole for a screw member to be inserted therethrough for fixing the footrest ring on the center tube of the chair when the bolt is turned tight and has its inner end pressing against the center tube. However, the way of the screw member pressing against the center tube for fixing the footrest ring on the chair has the following defects.

1. Generally, the center tube of a chair is a smooth round tube, and the footrest ring is fixed with the center tube of the chair only by having the inner end of a crew member pushing against the center tube with point contact; therefore, when the footrest ring is pressed downward by a treading force greater than the sustaining force of the screw member pressing the center tube, the footrest ring will be unable to bear such a treading force and likely to drop down.

2. Most conventional footrest rings are integrally made of plastic in order to economize cost; therefore, after the footrest ring is used for a long period of time and has its threaded hole repeatedly collided with the screw member due to treading force, the spiral teeth of the threaded hole will be deformed and damaged, so the footrest ring may become loosened to fall off.

3. The footrest ring of the chair can be adjusted in position by unscrewing or screwing tight the screw member with a wrist force, but this is no easy job for women or children.

SUMMARY OF THE INVENTION

The objective of this invention is to offer a constricting device for the footrest ring of a chair, able to stably fix the footrest ring on the center tube of a chair and conveniently adjust the level of the footrest ring on the center tube of the chair. The sleeve of the footrest ring to be fitted on the center tube of the chair is cone-shaped. The constricting device in the present invention includes a constricting unit assembled between the conical sleeve of the footrest ring and the center tube of the chair. The constricting unit consists of a constricting main body and a fixing ring for combining the constricting main body with the sleeve of the footrest ring. The constricting main body is a cone-shaped body to be fitted in the conical sleeve of the footrest ring, having its center bored with a fitting hole to be fitted around the center tube of the chair, and its circumferential wall cut with a plurality of axial grooves. By so designing, when the footrest ring is pressed downward by treading, the conical sleeve of the footrest ring will press the conical constricting main body and make it constricted to closely hold the center tube of the chair, achieving effect of stably fixing the footrest ring on the center tube of the chair. In addition, when the footrest ring is moved upward, the constricting main body will be released from being pressed by the footrest ring and will no longer hold tight the center tube of the chair, and hence the position of the footrest ring on the center tube of the chair can be adjusted conveniently.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
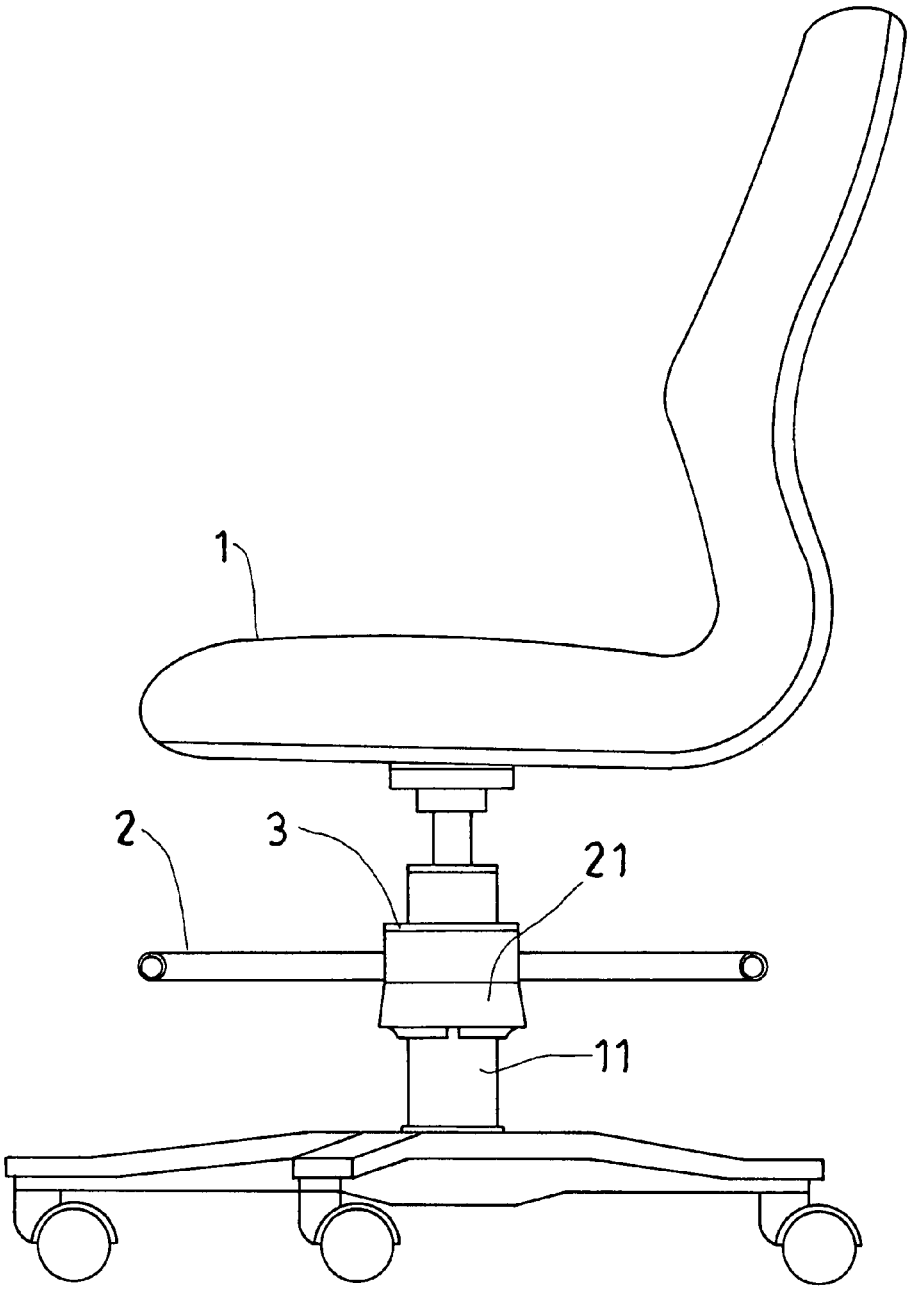
FIG. 1 is a side view of a constricting device for the footrest ring of a chair in the present invention.
Figure 2:
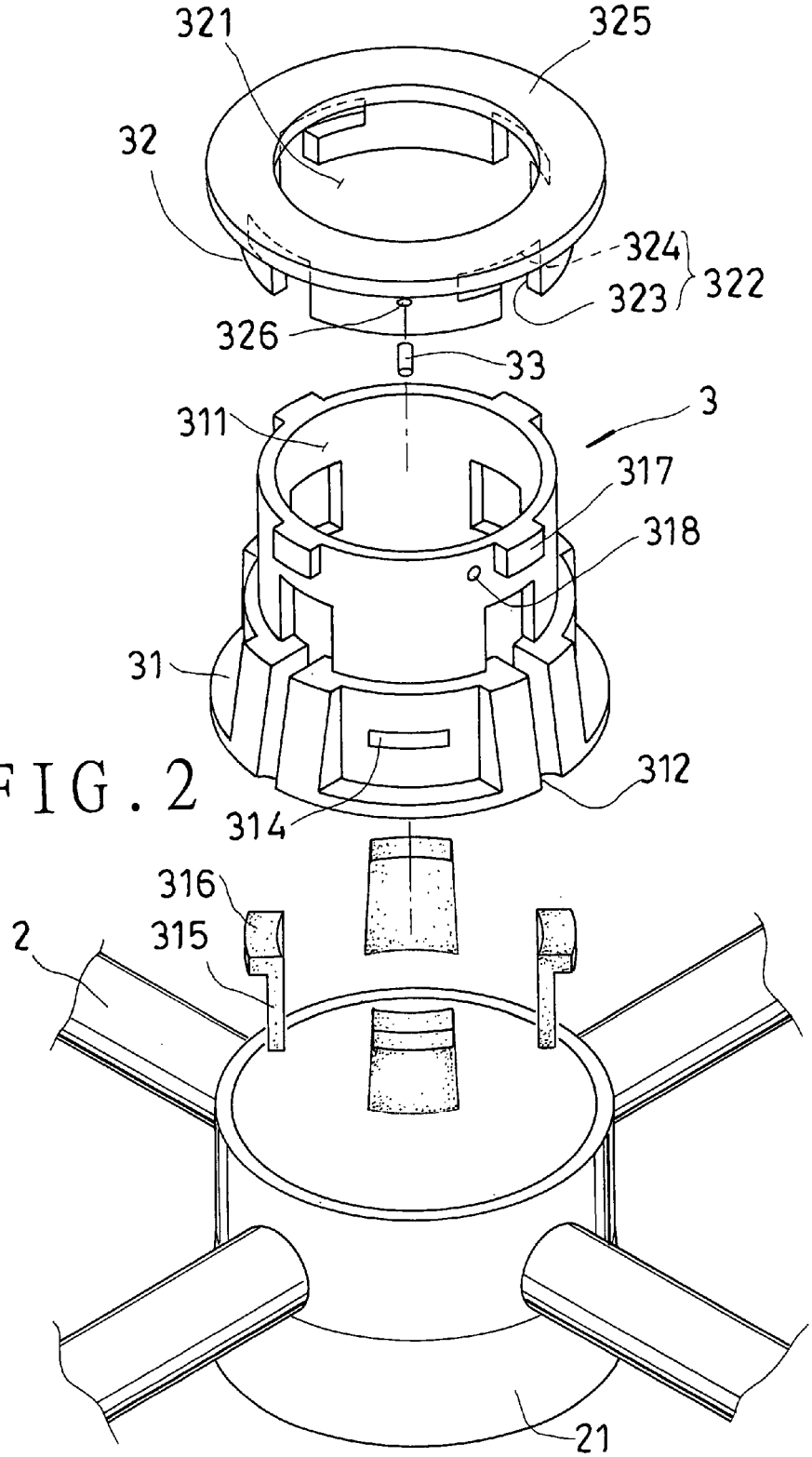
FIG. 2 is an exploded perspective view of the constricting device for the footrest ring of a chair in the present invention.

A preferred embodiment of a constricting device for the footrest ring of a chair in the present invention, as shown in FIGS. 1 and 2, includes a conical sleeve 21 secured in the center of the footrest ring 2 to be fitted on the center tube 11 of a chair 1, and a constricting unit 3 assembled between the sleeve 21 of the footrest ring 2 and the center tube 11 of the chair 1. The constricting unit 3 consists of a constricting main body 31 and a fixing ring 32 for combining the constricting main body 31 and the sleeve 21 of the footrest ring 2 together.

Figure 4:
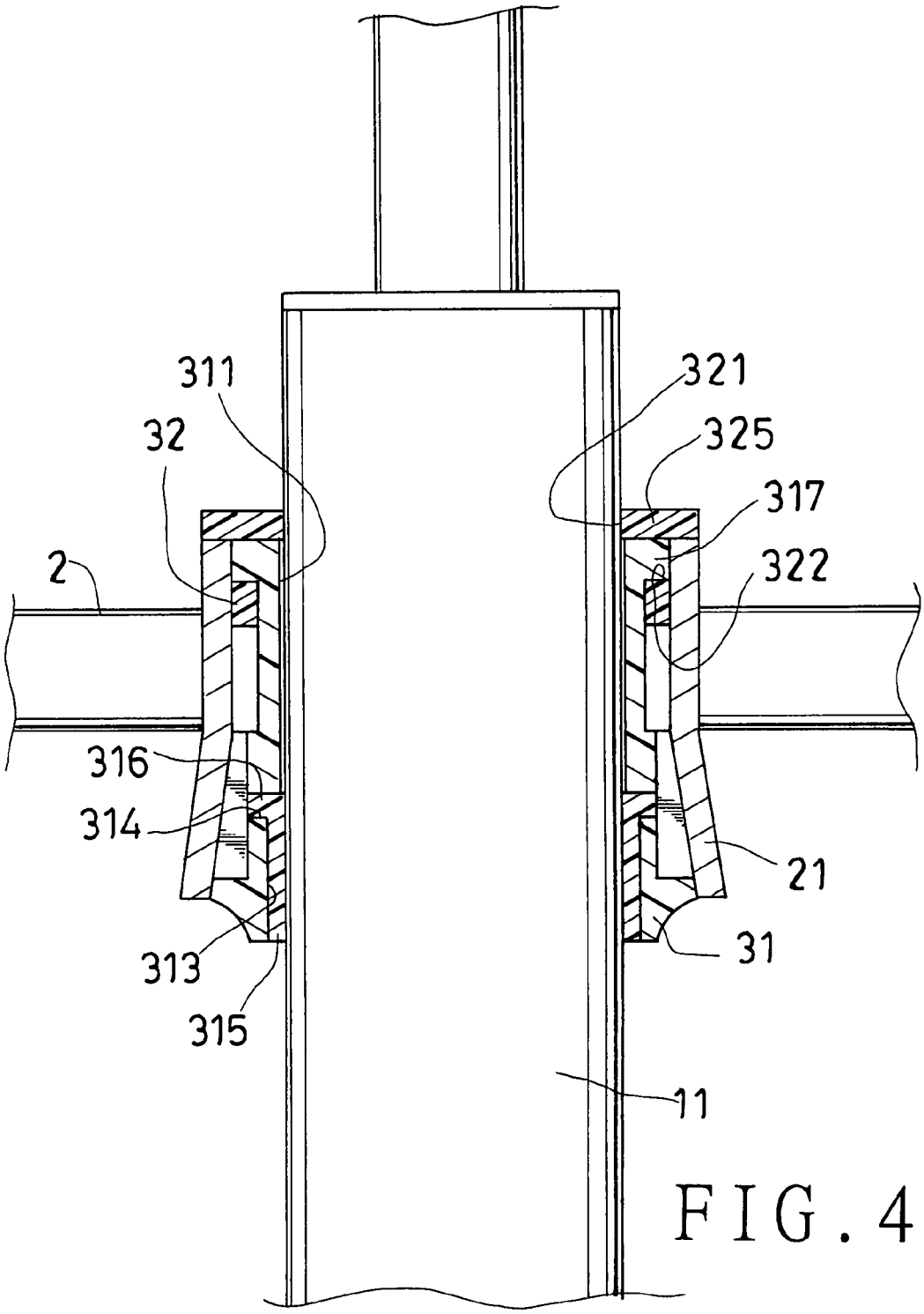
FIG. 4 is a partial side cross-sectional view of the constricting device for the footrest ring of a chair in the present invention.

The constricting main body 31 is a conical body to be fitted in the conical sleeve 21 of the footrest ring 2, having its center bored with a fitting hole 311 to be fitted with the center tube 11 of the chair 1 and its circumferential wall cut with at least one or more axial grooves 312 spaced apart equidistantly. Thus, when the constricting main body 31 is pressed to contract, these axial notches 312 can offer shrinking allowance for the constricting main body 31 to contract inward and firmly hold the center tube 11 of the chair 1. Furthermore, the constricting main body 31 has the inner wall of its fitting hole 311 annularly disposed with a plurality of recesses 313 having their walls respectively bored with an insert hole 314, and plural non-slip pads 315 respectively received in the recesses 313, having its upper end formed with a projecting block 316 to be engaged fixedly in the engage hole 314, as shown in FIG. 4. Moreover, the constricting main body 31 has its upper outer circumferential edge provided with a plurality of engage projections 317 spaced apart equidistantly to be engaged with the fixing ring 32.

The fixing ring 32 is an annular body having its center bored with a through hole 321 to be fitted around the center tube 11 of the chair 1. The fixing ring 32 has its circumferential wall bored with a plurality of engage openings 322 to be respectively engaged with the engage projections 317 of the constricting main body 31, and each engage openings 322 is formed with a groove 323 extending upward from the lower end of the fixing ring 32 and slanting for an angle to form an engage section 324. Additionally, the fixing ring 32 has a stop flange 325 formed at an upper edge and expanding outward for stopping and pressing the upper end of the sleeve 21 of the footrest ring 2, and its lateral side bored with a pin hole 326 matching witching the pin hole 318 of the constricting main body 31 for a positioning pin 33 to be inserted therein for combining the fixing ring 32 with the constricting main body 31 together.

Figure 3:
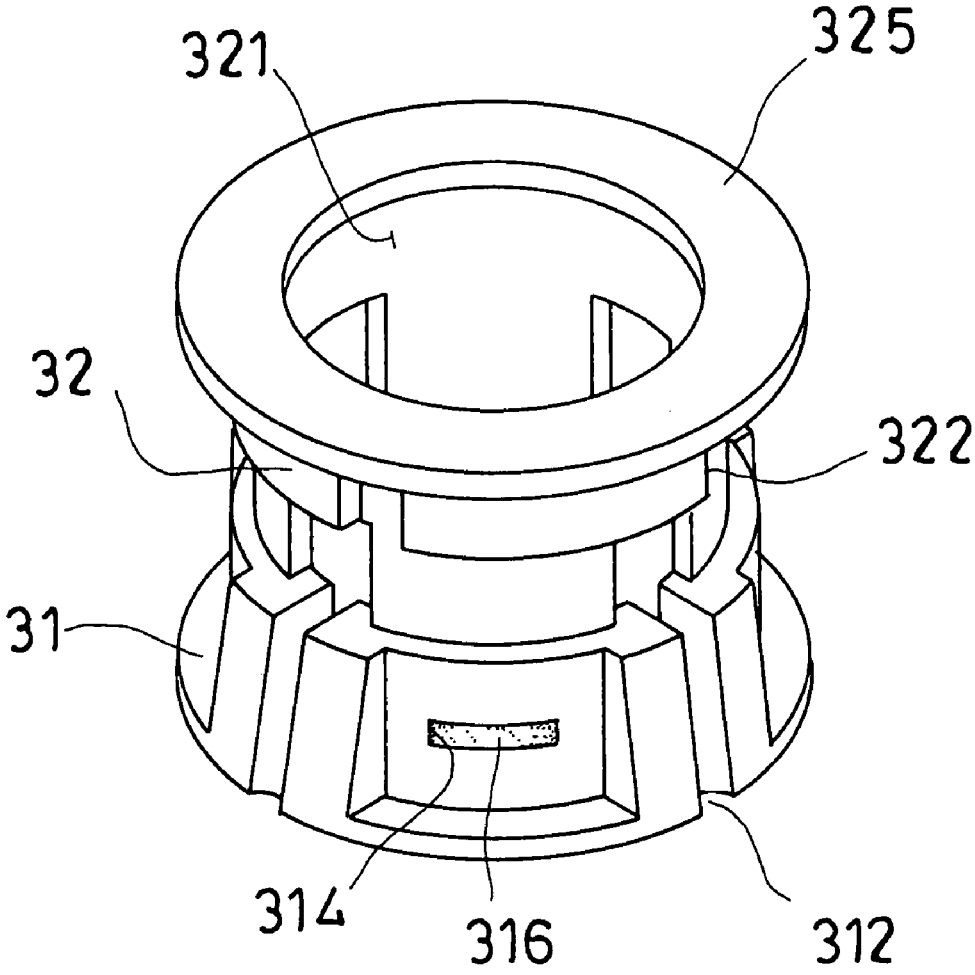
FIG. 3 is a perspective view of the constricting device for the footrest ring of a chair in the present invention.
Figure 5:
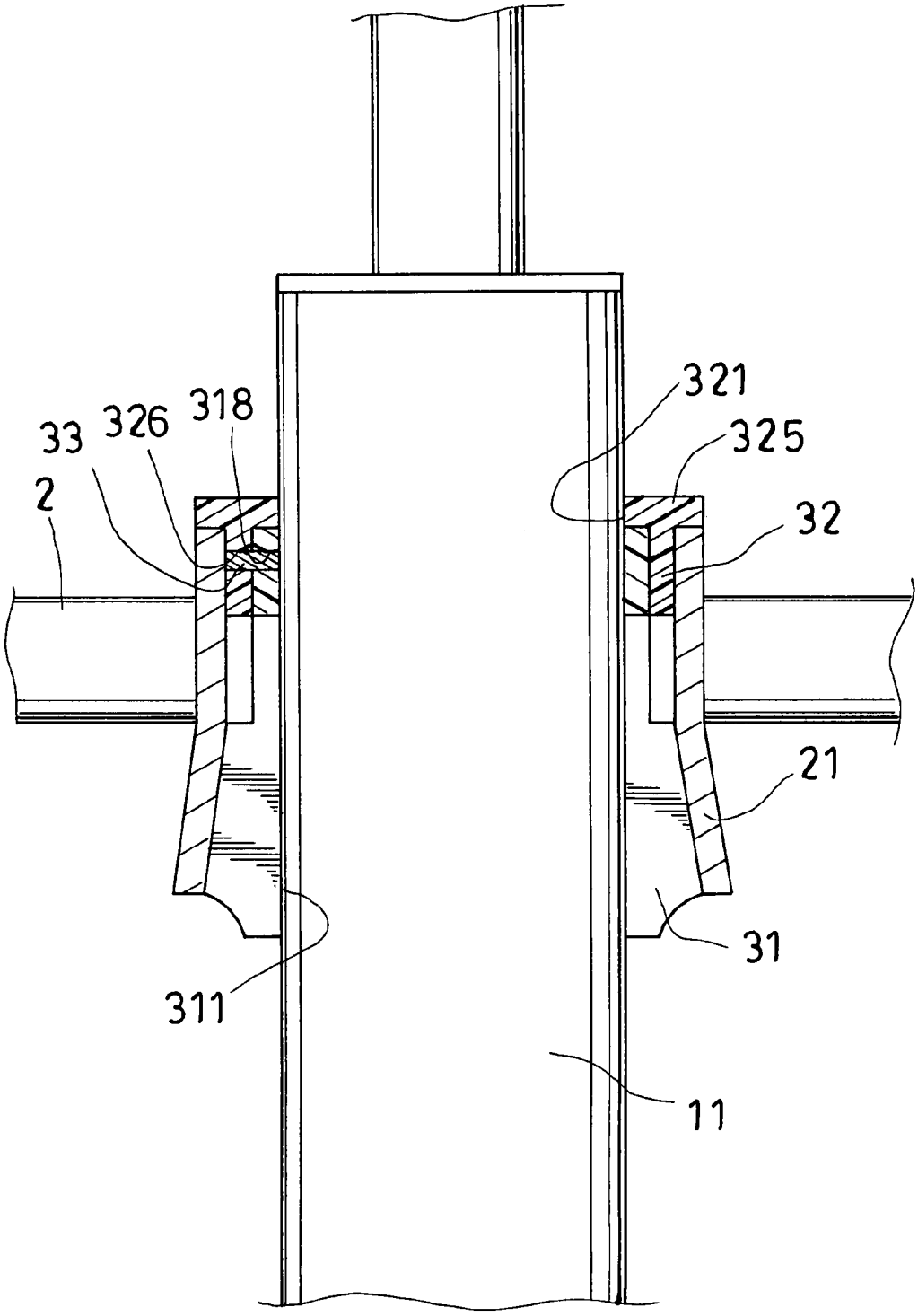
FIG. 5 is another partial side cross-sectional view of the constricting device for the footrest ring of a chair in the present invention.

In assembling, as shown in FIGS. 2 and 3, firstly, the constricting main body 31 of the constricting unit 3 is fitted in the sleeve 21 of the footrest ring 2, and then the fixing ring 32 has the groove 323 of the engage openings 322 respectively aligned to and engaged with the engage projections 317 of the constricting main body 31. Next, turn around the fixing ring 32 to move the engage projections 317 of the constricting main body 31 respectively to the engage sections 324 from the groove 323 of the fixing ring 32, letting the constricting main body 31 and the fixing ring 32 firmly engaged with each other, as shown in FIG. 4. At this time, the pin hole 326 and 318 of the fixing ring 32 and the constricting main body 31 are aligned to each other, with the positioning pin 33 inserted in the pin holes 326, 318 to combine the fixing ring 32 with the constricting main body 31 together, as shown in FIG. 5. Subsequently, the fixing ring 32 and the constricting main body 31 are together pushed and pressed in the interior of the sleeve 21 of the footrest ring 2, letting the stop flange 325 of the fixing ring 32 press against the upper end of the sleeve 21 and lastly, the center tube 11 of the chair 1 is fitted with the sleeve 21 of the footrest ring 2, which is fitted therein with the constricting unit 3.

In using, when a user treads on the footrest ring 2, the constricting unit 3 fitted in the sleeve 21 of the footrest ring 2 will be restrained by the non-slip pads 315 of the constricting main body 31 to let the conical sleeve 21 of the footrest ring 2 and the conical constricting main body 31 relatively press each other. When pressed, the constricting main body 31, by means of its axial grooves 312, can be forced to evenly contract inward and firmly hold the center tube 11 of the chair 1 and, the greater the treading force imposed upon the footrest ring 2 is, the more tightly the constricting main body 31 will be constricted and hence the greater holding force the constricting main body will produce to the center tube 11 of the chair 1, able to stably fix the footrest ring 2 on the center tube 11 of the chair 1. In addition, when the constricting main body 31 is forced to hold the center tube 11 of the chair, the non-slip pads 315 will simultaneously be actuated to closely push against the center tube 11 of the chair 1, producing a marked effect in preventing the footrest ring 2 from slipping and enabling the footrest ring 2 to be firmly fixed on the center tube 11 of the chair 1.

To adjust the level of the footrest ring 2, only move the footrest ring 2 upward to let the constricting main body 31 in the sleeve 21 no longer pressed by the sleeve 21, and released from being constricted not to hold tight the center tube 11 of the chair 1. At this time, the footrest ring 2 on the center tube 11 of the chair 1 can be adjusted to a proper treading-level.

As can be understood from the above description, this invention has the following advantages.

1. By relative mutual pressing of the conical sleeve of the footrest ring and the conical constricting main body positioned between the conical sleeve of the footrest ring and the center tube of the chair, when the footrest ring is pressed downward by treading, the conical sleeve of the footrest ring will be actuated to push against the conical constricting main body and force it to tightly hold the center tube of the chair, achieving effect of stably fixing the footrest ring on the center tube of the chair.

2. By means of the axial grooves bored in the circumferential wall of the constricting main body, when pressed to contract, the constricting main body can be evenly contracted to firmly hold the center tube of the chair, enabling the footrest ring to be stably secured on the center tube of the chair.

3. The fixing ring has its circumferential wall bored with a plurality of engage openings respectively engaged with the engage projections of the constricting main body, and its lateral side bored with the pin hole aligned to the pin hole of the constricting main body for the positioning pin to be inserted therein; therefore, the fixing ring and the constricting main body can be fixedly combined together.

4. The fixing ring has the stop flange formed at its upper edge so that the constricting main body combined with the fixing ring can be firmly fixed with the sleeve of the footrest ring not to fall off.

5. The constricting main body has the inner wall of its fitting hole annularly disposed with plural non-slip pads. Thus, when pressed downward by the sleeve of the footrest ring, the constricting main body, by means of these non-slip pads, can instantly hold the center tube of the chair, and after pressed to contact, the constricting main boy can firmly hold the center tube of the chair. In addition, when the constricting main body is pressed to hold the center tube of the chair, its non-slip pads will be tightly attached to the center tube of the chair, elevating effect of slip prevention.

6. To adjust the level of the footrest ring, simply pull the footrest ring upward to release the mutual pressing condition between the constricting main body and the footrest ring and loosen holding of the constricting main body to the center tube of the chair.

While the preferred embodiment of the invention has been described above, it will be recognized and understood that various modifications may be made therein and the appended claims are intended to cover all such modifications that may fall within the spirit and scope of the invention.

What is claimed is:

1. A constricting device which is secured to a footrest ring of a chair, comprising:

a constricting unit, said constricting unit being assembled between a conical sleeve of said footrest ring and a center tube of said chair, said sleeve of said footrest ring being a cone-shaped body to be fitted with said center tube of said chair, said constricting unit composed of a constricting main body and a fixing ring, said fixing ring having an upper edge extending outwardly to form a stop flange;

said constricting main body being conically shaped and fitted in said conical sleeve of said footrest ring, said fixing ring being engaged with an upper end of said constricting main body, said stop flange being greater in diameter than said sleeve of said footrest ring and contacting an upper end thereof to thereby secure said constricting main body within said sleeve of said footrest ring, said constricting main body having a centrally disposed fitting through bore to be fitted around said center tube of said chair, said constricting main body having its circumferential wall cut with a plurality of axial grooves spaced apart equidistantly; and said fitting through bore of said constricting main body having an inner wall annularly provided with a plurality of recesses, each recess having a wall with an insert hole formed therethrough, said constricting main body being further provided with a plurality of non-slip pads, each of said non-slip pads having an upper edge formed with a projecting block, said non-slip pads being respectively positioned in said recesses, said projecting blocks of non-slip pads being respectively inserted in said insert holes.

2. A constricting device which is secured to a footrest ring of a chair, comprising:

a constricting unit, said constricting unit being assembled between a conical sleeve of said footrest ring and a center tube of said chair, said sleeve of said footrest ring being a cone-shaped body to be fitted with said center tube of said chair, said constricting unit composed of a constricting main body and a fixing ring, said fixing ring having an upper edge extending outwardly to form a stop flange;

said constricting main body being conically shaped and fitted in said conical sleeve of said footrest ring, said fixing ring being engaged with an upper end of said constricting main body, said stop flange being greater in diameter than said sleeve of said footrest ring and contacting an upper end thereof to thereby secure said constricting main body within said sleeve of said footrest ring, said constricting main body having a centrally disposed fitting through bore to be fitted around said center tube of said chair, said constricting main body having its circumferential wall cut with a plurality of axial grooves spaced apart equidistantly; and said fixing ring having a centrally disposed through bore fitted around said center tube of said chair, and a plurality of engage openings spaced apart in a circumferential wall thereof, and said constricting main body having an upper edge provided with a plurality of engage projections spaced apart to be respectively engaged with said engage openings of said fixing ring.

3. The constricting device which is secured to a footrest ring of a chair as claimed in claim 2, wherein each said engage opening of said fixing ring is formed with a groove extending upward from a lower end of said fixing ring and slanting for an angle to form an engage section, said engage projections of said constricting main body turned to be respectively engaged with said engage sections of said fixing ring after said engage projections are respectively inserted in said grooves of said fixing ring.

4. A constricting device which is secured to a footrest ring of a chair, comprising:

a constricting unit, said constricting unit being assembled between a conical sleeve of said footrest ring and a center tube of said chair, said sleeve of said footrest ring being a cone-shaped body to be fitted with said center tube of said chair, said constricting unit composed of a constricting main body and a fixing ring, said fixing ring having an upper edge extending outwardly to form a stop flange;

said constricting main body being conically shaped and fitted in said conical sleeve of said footrest ring, said fixing ring being engaged with an upper end of said constricting main body, said stop flange being greater in diameter than said sleeve of said footrest ring and contacting an upper end thereof to thereby secure said constricting main body within said sleeve of said footrest ring, said constricting main body having a centrally disposed through bore to be fitted around said center tube of said chair, said constricting main body having its circumferential wall cut with a plurality of axial grooves spaced apart equidistantly; and said fixing ring and said constricting main body being respectively bored with a pin hole aligned to each other for a positioning pin to be inserted therein for affixing said fixing ring with said constricting main body.

* * * * *